US006256832B1

(12) United States Patent
Dyson

(10) Patent No.: US 6,256,832 B1
(45) Date of Patent: Jul. 10, 2001

(54) VACUUM CLEANER

(75) Inventor: James Dyson, Little Somerford (GB)

(73) Assignee: Notetry Limited, Wiltshire (GB)

( * ) Notice: Subject to any disclaimer, the term of this patent is extended or adjusted under 35 U.S.C. 154(b) by 0 days.

(21) Appl. No.: 09/355,498

(22) PCT Filed: Jan. 30, 1998

(86) PCT No.: PCT/GB98/00295

§ 371 Date: Oct. 18, 1999

§ 102(e) Date: Oct. 18, 1999

(87) PCT Pub. No.: WO98/33424

PCT Pub. Date: Aug. 6, 1998

(30) Foreign Application Priority Data

Jan. 30, 1997 (GB) ..... 9701857

(51) Int. Cl.[7] ..... A47L 9/00; A47L 9/30
(52) U.S. Cl. ..... 15/324; 15/337; 15/339
(58) Field of Search ..... 15/339, 337, 324

(56) References Cited

U.S. PATENT DOCUMENTS

| | | | | |
|---|---|---|---|---|
| 1,209,722 | * | 12/1916 | Kirby | 15/337 X |
| 1,483,977 | * | 2/1924 | Hoover | 15/337 |
| 1,575,363 | * | 3/1926 | Hettelsater | 15/337 |
| 2,140,143 | * | 12/1938 | Sellers et al. | 15/337 X |
| 2,618,007 | * | 11/1952 | Fuller | 15/337 X |
| 2,730,750 | | 1/1956 | La Briere . | |
| 3,184,775 | * | 5/1965 | Downey et al. | 15/339 X |
| 3,277,512 | * | 10/1966 | Waters | 15/337 X |
| 4,023,234 | * | 5/1977 | Martinec et al. | 15/339 X |
| 4,068,341 | | 1/1978 | Scott et al. . | |
| 4,219,900 | * | 9/1980 | Dyer | 15/339 |
| 4,384,385 | * | 5/1983 | Maurer | 15/339 |
| 4,490,882 | * | 1/1985 | Wells | 15/337 |
| 4,563,790 | * | 1/1986 | Clark | 15/337 |
| 5,014,388 | * | 5/1991 | Schiazza et al. | 15/339 |
| 5,063,634 | | 11/1991 | Hafele et al. . | |
| 5,101,532 | | 4/1992 | Dyson et al. . | |
| 5,101,534 | | 4/1992 | Watanabe et al. . | |
| 5,373,598 | | 12/1994 | Weber et al. . | |
| 5,467,501 | | 11/1995 | Sepke . | |
| 6,070,291 | * | 6/2000 | Bair et al. | 15/353 X |

FOREIGN PATENT DOCUMENTS

| | | |
|---|---|---|
| 0 338 513 A2 | 4/1989 | (EP) . |
| 2 105 183 | 3/1983 | (GB) . |

* cited by examiner

*Primary Examiner*—Chris K. Moore
(74) *Attorney, Agent, or Firm*—Morrison & Foerster, LLP

(57) ABSTRACT

The invention provides a vacuum cleaner (2) having a cleaner head (8) comprising a dirty air inlet (12) and a passage 20) forming an airflow path for dirty air entering the dirty air inlet (12). Access means (24, 26) are provided for allowing access to the airflow path (20) to facilitate cleaning thereof and or removal of blockages therefrom. A transparent portion is provided in an outer casing (22) of the cleaner head (8) to allow the interior of the airflow path (20) to be visually inspected. The improved vacuum cleaner facilitates use and maintenance of the vacuum cleaner (2) by enabling a user to easily and quickly detect and remove blockages in the airflow path (20) between the dirty air inlet (12) and dust separating apparatus (6).

15 Claims, 4 Drawing Sheets

FIG. 3(b)(ii)

VACUUM CLEANER

The invention relates to a vacuum cleaner.

A vacuum cleaner, whether industrial or domestic, essentially comprises an airflow path in which is arranged separation apparatus for separating dirt and dust from the air drawn along the airflow path by a fan driven by a motor. It is inevitable that the airflow path will have areas in which blockages can occur. Blockages often occur in areas of the airflow path where there is a change in direction and/or a reduction in cross section. Areas of this type occurring upstream of the separation apparatus are particularly prone to blockage.

The most common type of vacuum cleaner is the upright cleaner. An upright cleaner consists of a ground engaging cleaner head having a downwardly open dirty air inlet or mouth in which is arranged a brush bar or beater. Dirt and dust is dislodged from the carpet or other floor covering by the rotating brush bar or beater and the dirt and dust is drawn into the cleaner head by virtue of the suction produced by the downstream fan. Dirt laden air is then passed to dust separation apparatus before clean air is expelled to the atmosphere. The area of the airflow path between the brush bar or beater and the dust separation apparatus normally incorporates a reduction in cross section and a number of changes in direction. This area of the airflow path is therefore prone to blockage. It is also one of the most awkward areas to access in an upright vacuum cleaner. Indeed, access is often impossible without removing one or more of the structural panels of the cleaner head, none of which is intended by the manufacturer to be removed by a user. Manufacturers often deliberately design the cleaner head casing to be extremely difficult to remove which can then prevent any access at all to the airflow path between the brush bar and separation apparatus. This makes everyday maintenance of the vacuum cleaner difficult, if not impossible, for the user.

A floor tool of a cylinder vacuum cleaner which has an upper cover portion which is removable to allow the brush bar to be removed is known from EP-A-338513. Further, provision of a hopper for discharging a cleaning composition onto the surface to be cleaned having a transparent, removable cover is known from U.S. Pat. No. 5,101,532.

It is an object of the invention to provide a vacuum cleaner which is more easily operated and maintained by the user. It is a further object of the invention to provide a vacuum cleaner from which blockages can be more easily removed. A further object of the invention is to provide a vacuum cleaner whose airflow path can be easily cleaned by the user.

The invention provides a vacuum cleaner as claimed in claim 1. Further advantageous features are set out in the subsidiary claims.

The provision of access means allowing access to the airflow path gives a user easy access to the airflow path in order to clean the airflow path or remove any blockages. Providing a transparent portion of the outer casing, or a transparent door or panel, allows the user to inspect the airflow path for blockages prior to a user gaining physical access to the access passage and into the airflow path. The provision of an access passage extending between the outer casing and the airflow path is preferred and defines a clear path through which a user's hand or fingers may reach into the airflow path so as to carry out cleaning or removal of a blockage. The provision of a movable or removable door or panel in the outer casing, or a movable or removable outer casing or part thereof, positioned so as to close the access passage during normal operation of the vacuum cleaner is a feature of a preferred embodiment. The outer casing may be made completely transparent if desired. Preferably, a light is provided inside the cleaner head to facilitate visual inspection. Another preferred feature is cut-off means for ensuring that the brush bar or beater is stopped prior to the user's hand or fingers being passed into the airflow path. This is an important safety feature.

Various embodiments of the invention will now be described with reference to the accompanying drawings wherein.

Figure 1:
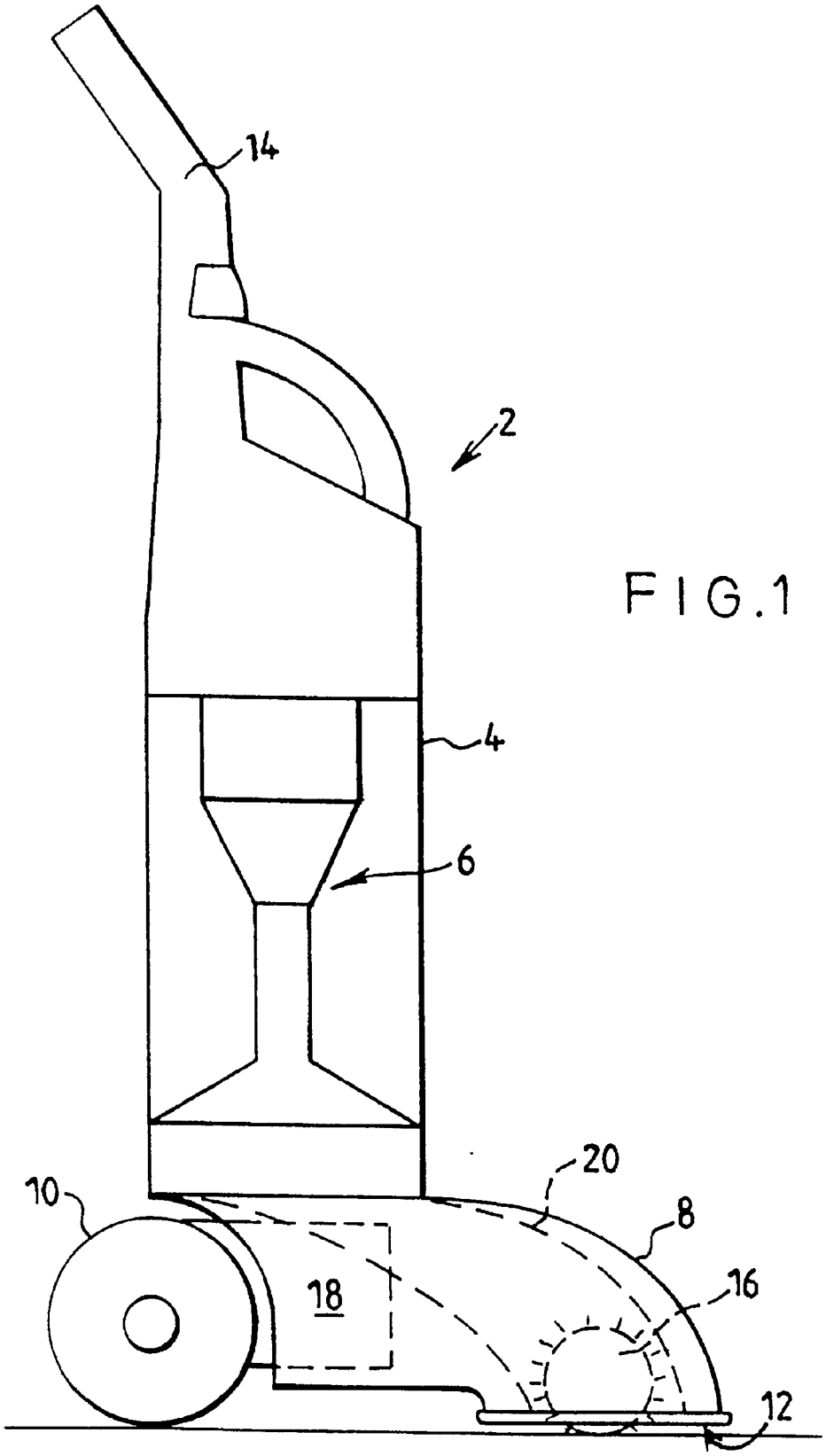
FIG. 1 is a schematic side view of a known upright vacuum cleaner.

FIG. 1 illustrates a known upright vacuum cleaner. The vacuum cleaner 2 comprises a body 4 housing dust separation apparatus 6. In this illustration, the dust separation apparatus 6 consists of two concentric cyclones but these could be replaced by a single cyclone, a filter bag or a combination of a cyclone and a filter bag. The dust separation apparatus 6 does not form part of the present invention and will not be described any further here.

The vacuum cleaner 2 also comprises a ground engaging cleaner head 8 arranged generally below the body 4 and having rear wheels 10 and a forward dirty air inlet 12. A handle 14 projects upwardly away from the body 4 which is pivotably connected to the cleaner head 8. A brush bar or beater 16 is rotatably mounted in the mouth of the dirty air inlet 12 and is drivably rotated by a motor 18, which is mounted generally between the rear wheels 10 and below the body 4. The motor 18 has a drive belt (not shown for clarity) which causes rotation of the brush bar 16. Extending between the dirty air inlet 12 and the body 4 is a passage 20 which defines an airflow path for carrying dirt laden air from the dirty air inlet 12 to the dust separation apparatus 6. A further airflow passage (not shown) is provided downstream of the dust separation apparatus 6 for carrying the airflow from the dust separation apparatus 6 to a clean air outlet (not shown). The motor 18 is positioned in the further airflow passage.

The motor 18 also drives a fan (not shown) which draws air into the dirty air inlet 12, past the brush bar 16, along the passage 20, through the dust separation apparatus 6, into the further airflow path, past the motor 18 to the clean air outlet. The rotation of the brush bar 16 agitates the carpet or other floor covering upon which the vacuum cleaner 2 is being used and any dirt or dust particles released from the carpet or floor covering by the rotation of the brush bar are drawn along the passage 20 to the dust separation apparatus 6. These dirt and dust particles are there separated from the airflow so as to allow clean air to be expelled into the environment.

Figure 2:
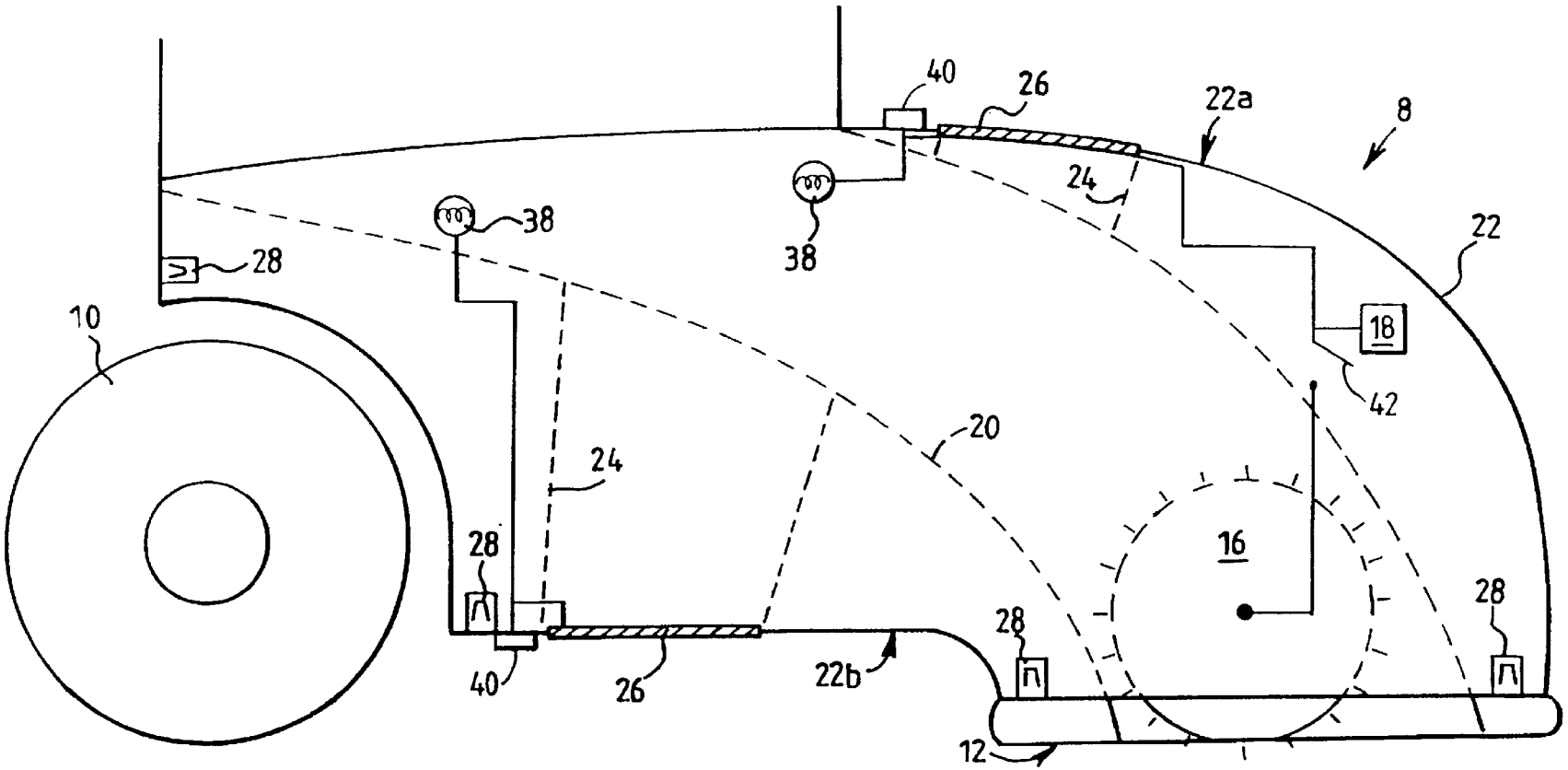
FIG. 2 is an enlarged, schematic side view of the cleaner head of a vacuum cleaner similar to that shown in FIG. 1 but incorporating the present invention.

The passage 20 leading from the brush bar 16 to the dust separation apparatus 6 is prone to blockage and frequently requires cleaning. However, this part of the airflow path is extremely difficult to access. FIG. 2 illustrates the present invention which provides a vacuum cleaner having improved access to the airflow passage 20.

The cleaner head 8 illustrated in FIG. 2 has an outer casing 22 comprising an upper surface 22*a* and an underneath surface 22*b*. The upper surface 22*a* and the underneath surface 22*b* together form a substantially closed outer casing 22 for the cleaner head 8. The arrangement of components within the outer casing 22 is such that the airflow passage 20 is kept substantially clear. Furthermore, an access passage 24 is also kept clear so as to allow sufficient space for a user's hand or fingers to pass along the access passage 24 into the airflow passage 20. Two alternative access passages 24 are illustrated in FIG. 2. Normally, only one access passage will be provided, extending either from the airflow passage 20 upwardly to the upper surface 22*a* of the outer casing 22 or downwardly from the airflow passage 20 to the underneath surface 22*b* of the outer casing 22. The object is to allow a user of the vacuum cleaner sufficient access to remove blockages from the airflow passage 20 if and when they occur. Two or even more access passages 24 could be provided giving access to different parts of the airflow passage 20 from either the upper surface 22*a* or from the underneath surface 22*b* of the outer casing 22. Normally, it is envisaged that only one access passage 24 will be required.

The access passage or passages 24 must be closed during normal operation of the vacuum cleaner 2. A portion of the outer casing 22 closes the or each access passage 24. In FIG. 2, each access passage 24 is closed by a movable or removable door or panel 26 arranged in the relevant surface 22*a*, 22*b* of the outer casing 22. Preferred arrangements of the door or panel will be described later. Alternatively, no door or panel 26 need be provided in the relevant surface of the outer casing 22. In order to gain access to the access passage 24, the whole of the relevant surface 22*a*, 22*b* of the outer casing 22 can be removed. In order to facilitate this, snap-fitting or quick-release fastening means are provided to secure the relevant surface of the outer casing 22 to the structure of the machine. Appropriate fastenings 28 are illustrated schematically in FIG. 2. Any appropriate type of snap-fitting or quick-release fastening means can be used such as resilient tabs which are biased into engagement with a lip and released by depressing a button to disengage the tab from the lip. Rotatable catches such as those illustrated in FIGS. 3(*b*) and 3(*c*) can also be used. To allow the user to inspect the air flow path for blockages prior to gaining access to the access passage 24, at least a portion of the outer casing 22 or the door or panel 26 is transparent.

In the event that an access passage 24 is provided between the upper surface 22*a* of the outer casing 22 and the airflow passage 20, but that no door or panel 26 is provided in the outer casing, the whole of the upper surface 22*a* of the outer casing 22 must be removed in order to gain the necessary access. The fastenings 28 are operated so as to remove the upper surface 22*a* of the outer casing and the user of the vacuum cleaner 2 can then insert a hand or some fingers into the airflow passage 20 via the access passage 24. Once the blockage has been removed or the necessary cleaning carried out, the upper surface 22*a* of the outer casing 22 is replaced and fastened by means of the fastenings 28. Similarly, if an access passage 24 is provided between the airflow passage 20 and the underneath surface 22*b* of the outer casing 22, the whole of the underneath surface 22*b* must be released by operating the fastenings 28 and removed to allow the user to gain access to the airflow passage 20 via the access passage 24. Once the necessary cleaning or blockage removal has been completed, the underneath surface 22*b* can be replaced and fastened by means of the fastenings 28.

It will be appreciated that a portion or part of either or both of the upper surface 22*a* and underneath surface 22*b* can also be made removable in order to allow the user to gain access to the airflow passage 20 via the access passage 24. It is essential only that a part of either or both of the upper surface 22*a* and underneath surface 22*b* sufficiently large to allow appropriate access be removable.

It is also envisaged that the upper surface 22*a*, the underneath surface 22*b* or an appropriate part thereof can be made completely and freely removable from the vacuum cleaner 2 or can be movable so as to allow access without becoming detached from the vacuum cleaner. A convenient arrangement is to provide a hinge and releasable fastening means so that, when the releasable fastening means are released, the surface 22*a*, 22*b* or part thereof becomes pivotably movable about the hinge. The pivotable movement will allow sufficient access by the user to the airflow passage 20 via the access passage 24. The fact that the surface 22*a*, 22*b* or part thereof remains attached to the vacuum cleaner 2 means that there is a reduced risk of the surface 22*a*, 22*b* or part thereof being misplaced or accidentally damaged.

In an alternative, preferred embodiment, a movable or removable door or panel 26 is provided in the outer casing 22 at the end of the or each access passage 24. Alternative arrangements of a suitable door or panel are illustrated in FIG. 3.

In a first preferred arrangement, the access passage 24 is closed by a door 26 which is slidably movable relative to the outer casing 22. When the door 26 is in the closed position and retained closed by snap fittings or quick release fastening means (not shown), the seal between the door or panel 26 and the outer casing 22 is sufficiently airtight to prevent any substantial inflow of air around the door or panel 26. Gripping means 30 are provided on the door or panel 26 to facilitate the sliding of the door or panel 26 into an open position so as to allow access by the user to the access passage 24. The gripping means can take the form of a protruding handle, a thumb-nail slot or other indentation for engagement with a convenient tool.

Figure 3A:
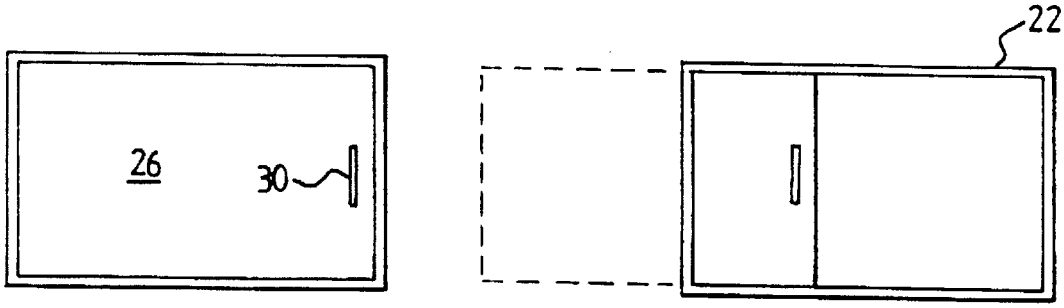
FIGS. 3*a, b* and *c* illustrate alternative embodiments of a movable or removable panel or door for closing an access passage forming part of the invention.
Figure 3B:
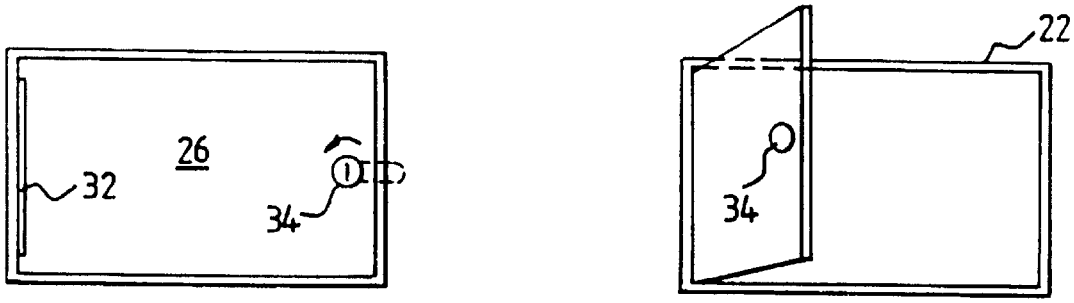
Figure 3B:
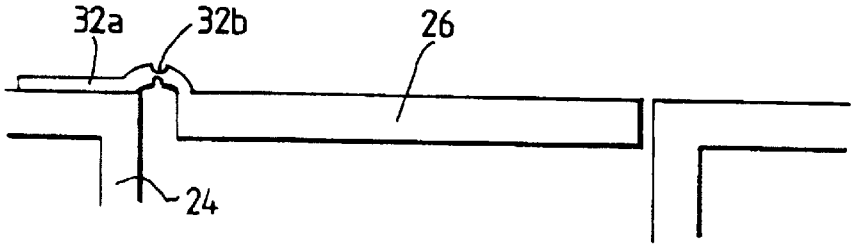

FIG. 3*b* illustrates a door or panel 26 connected to the surrounding outer casing 22 by means of a hinge 32. One or more snap fittings or quick release fastenings 34 are provided on the door or panel 26 remote from the hinge 32 so that the door or panel 26 can be held in a closed position or opened in the manner of a door. When the door or panel 26 is in a closed position, the seal between the door 26 and the outer casing 22 is again sufficient to prevent any substantial inflow of air during normal operation of the vacuum cleaner 2. Opening the door 26 allows the user access to the airflow passage 20 via the access passage 24. Any suitable type of hinge can be employed. For example, a tab 32*a* incorporating a weakened strip 32*b* could be moulded integrally with the door or panel 26 and then fixedly attached by adhesives to the periphery of the end of the access passage 24. Alternatively, projections 32*c* extending outwardly along the line of one side of the door or panel 26 could be moulded integrally with the door or panel 26 and corresponding recesses 32*d* could be formed in the entrance to the access passage 24 so as to allow snap-fitting engagement of the projections 32*c* in the recesses 32*d* and subsequent relative rotation therebetween about the line of the side of the door or panel 26. Those alternative arrangements are illustrated in FIGS. 3(*b*)(i) and 3(*b*)(ii) respectively.

Figure 3C:
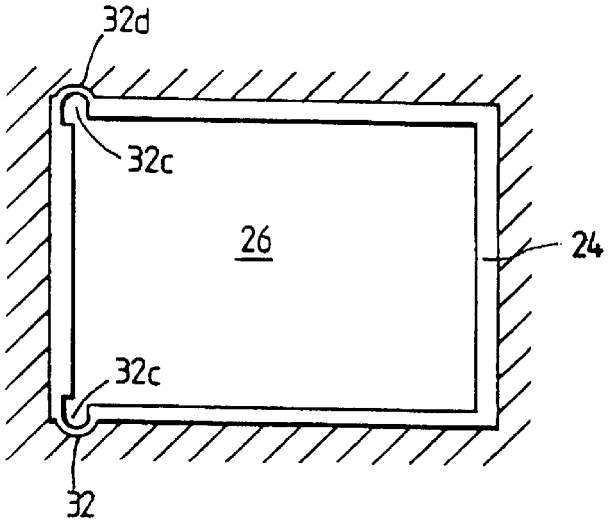
Figure 3C:
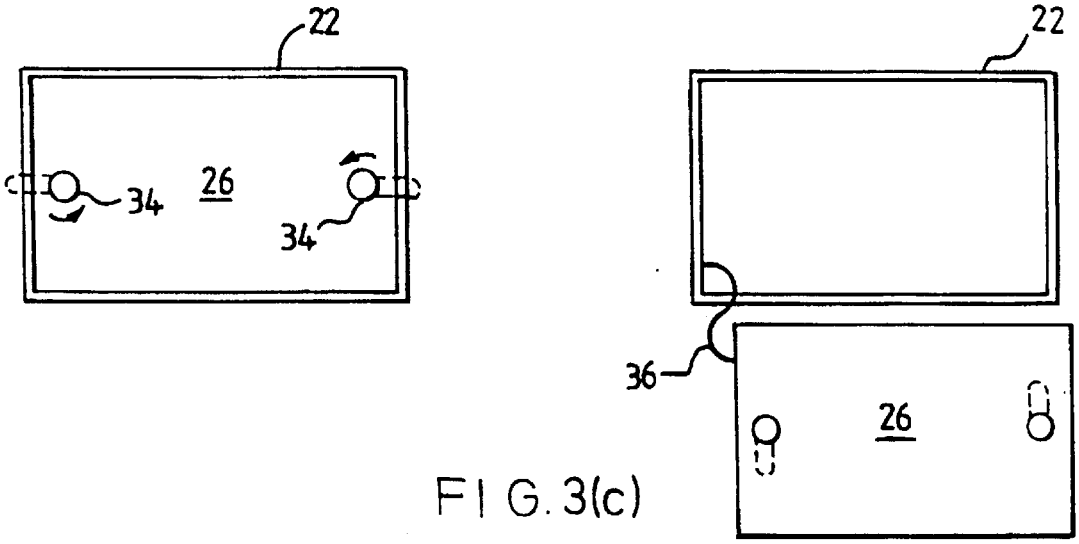

A third alternative arrangement is illustrated in FIG. 3*c*. In this arrangement. The door or panel 26 is removable from the outer casing 22 by the release of a plurality of fasteners 34 similar to the fastener illustrated in FIG. 3*b*. In FIG. 3*c*, two fasteners are illustrated: in practice, any convenient number of fasteners can be provided. The fasteners are preferably of known design and will not be described any further here, other than to again specify that, when the door or panel 26 is in the closed position, the seal between the door or panel 26 and the outer casing 22 is sufficiently airtight to prevent any substantial inflow of air between the outer casing 22 and the door or panel 26 during normal operation of the vacuum cleaner. When the fasteners 34 are released, the door or panel 26 is freely removable from the outer casing 22. However, a tether or other flexible connector 36 is preferably provided in order to reduce the risk of inadvertent loss or misplacement of the door or panel 26.

Any of the arrangements described above in relation to FIG. 3 could be used to close the access passage 24 in the cleaner head 8. If more than one access passage 24 is provided in the cleaner head 8, the access passages could each be closed by the same type of door or panel or by different types if required.

It is highly advantageous if a user of the vacuum cleaner 2 can be provided with visual access to the airflow passage 20. This avoids unnecessary physical access to the airflow passage 20 which could occasionally result in erroneous replacement of the door or panel 26 or the upper or underneath surface 22*a,* 22*b* of the outer casing 22. Erroneous replacement of the door or panel or relevant surface would result in unsatisfactory performance of the vacuum cleaner. It is therefore preferable to reduce the frequency of physical access to the airflow passage as far as possible. Providing a transparent panel in the outer casing 22 assists the user to determine whether or not physical access is required. If no door or panel 26 is provided in the outer case 22, then the portion of the outer casing 22 at the end of the access passage 24 is preferably transparent. Referring to FIG. 2, the relevant transparent portion coincides with the door or panel 26 illustrated. In use, the user can view the airflow passage 20 by looking through the transparent portion (located at 26) and along the access passage 24. If it is considered that physical access is required to clean the airflow passage 20 or remove a blockage, then the upper surface 22*a,* or a part of the upper surface, or underneath surface 22*b,* or a part of the underneath surface, is removed as necessary by releasing the fastenings 28 and inserting the hand or fingers along the access passage 24 into the airflow passage 20. Once the airflow passage 20 has been cleaned or unblocked as required, the upper surface 22*a* or underneath surface 22*b* or part thereof is replaced and fastened by means of fastenings 28.

Visual access can also be provided by manufacturing the entire upper surface 22*a* or underneath surface 22*b,* or both, from a transparent material. The airflow passage 20 can then be inspected before one of the surfaces 22*a,* 22*b* is moved or removed to allow physical access to the airflow passage 20 in the event of a blockage.

If a door or panel 26 is provided in the outer casing at the end of an access passage 24, then this door or panel 26 can be made transparent. This allows the user visual access in order to determine whether or not physical access is required. It will be appreciated that the door or panel can also include a transparent portion forming part of the door or panel if desired. As an alternative, a transparent portion can be provided in a part of the outer casing 22 other than the door or panel 26. If appropriate visual access is available, the transparent portion can be located adjacent the door or panel 26 or remote therefrom. Two alternative access passages 24 are illustrated in FIG. 2: it would be possible to provide both access passages 24 in a cleaner head 8, one access passage having a door or panel 26 at the outer end thereof, whilst the other access passage incorporates a transparent panel. Such an arrangement would provide visual and physical access through different access passages.

The visual access described above can be further enhanced by the provision of a light or lights 38 inside the cleaner head 8 and specifically inside the airflow passage 20. In the preferred embodiment illustrated in FIG. 2, lights 38 are provided in the airflow passage 20. It is particularly advantageous if the light or lights 38 are provided in the airflow passage 20 remote from the dirty air inlet 12. The portions of the airflow passage 20 which are darkest and most likely to block are those furthest from the dirty air inlet 12.

The lights 38 could be arranged to remain on at all times so as to illuminate the airflow passage 20 at all times. Preferably, the lights 38 are connected to an independent power source, such as a battery. Alternatively the lights 38 can be connected to the mains supply to the vacuum cleaner. It is anticipated that illumination of the airflow passage 20 will be required when the motor 18 is switched off. However, rather than provide for constant illumination of the airflow passage 20, it would be more preferable to illuminate the airflow passage 20 only when visual and/or physical access is required. Preferably, therefore, a manual switch 40 will be provided on the outer casing 22, for example, in the form of a push button so that the user can illuminate the airflow passage 20 only when required.

When the only means of access, visual or physical, is by way of opening the door or panel 26 illustrated in FIG. 2, then it is possible to provide for the light 38 to come on when the door or panel 26 is opened. Electrical connections can be provided in the form of simple switches, known per se, which ensure that the light 38 is illuminated as soon as the door or panel 26 is opened or removed, thereby providing illumination inside the airflow passage 20 to assist the user in determining visually whether cleaning or blockage removal is required.

It is appreciated that it would be dangerous for a user to insert a hand or fingers into the airflow passage 20 whilst the brush bar 16 is rotating. It is therefore preferred and expected that cut-off means will be provided for disengaging the drive to the brush bar when physical access to the airflow passage 20 is made. This can be achieved by disconnecting the cleaner from the mains supply or, as illustrated only schematically in the drawings, a simple electrical cut-off switch 42 of known design can be incorporated into the vacuum cleaner, particularly when a movable or removable door or panel 26 is opened or a movable or removable outer casing 22 or part thereof is opened. A simple circuit breaker can be included to ensure that the motor 18 is disengaged or switched off as soon as the door or panel 26 is opened to provide access through the access passage 24. Alternatively, a simple mechanical linkage or electrical circuitry can be used to operate a clutch or other means for disengaging the drive to the brush bar as soon as the movable or removable door or panel 26 is opened or a movable or removable outer casing 22 or part thereof is opened. One or more of these safety features are absolutely essential if the access passage 24 is sufficiently close to the brush bar to enable a user's fingers to contact the brush bar via the access passage 24.

It will be appreciated that there are many alternative variations of the invention which have been described and envisaged in the foregoing description. Essentially, the invention provides for physical and visual access to the airflow passage in order to clean the airflow passage or remove blockages. The physical access is gained by providing a movable or removable cleaner head outer casing or part thereof, or by providing a movable or removable panel or door. The visual access is gained by providing a transparent portion in the outer casing. The transparent portion can be located in the movable or removable panel or door, if one is provided. Illumination means add to the user's ability to determine whether or not a blockage has occurred and safety means are provided for preventing a user from accessing the airflow passage with his fingers whilst the brush bar is still rotating.

What is claimed is:

1. A vacuum cleaner comprising a main body containing dust separation apparatus and a cleaner head connected to the main body, the cleaner head comprising an airflow passage; a downwardly directed dirty air inlet, a brush bar rotatably supported in the airflow passage adjacent the dirty air inlet, and a removable cover portion on an upper surface of the cleaner head, wherein the removable cover portion is located to allow physical access to a portion of the airflow passage adjacent to the brush bar.

2. A vacuum cleaner as claimed in claim 1, wherein the removable cover portion is hingedly connected to an upper surface of the cleaner head.

3. A vacuum cleaner as claimed in claim 1, wherein the removable cover portion is slidingly connected to an upper surface of the cleaner head.

4. A vacuum cleaner as claimed in claim 1, wherein a tether is provided between the removable cover portion and the cleaner head.

5. A vacuum cleaner as claimed in claim 1, wherein the removable cover portion is held in position by quick-release fasteners.

6. A vacuum cleaner as claimed in claim 5, wherein the quick-release fasteners are quarter-turn fasteners.

7. A vacuum cleaner as claimed in claim 1, wherein the removable cover portion is held in position by snap-fit fasteners.

8. A vacuum cleaner as claimed in claim 1, wherein a light is provided inside the cleaner head.

9. A vacuum cleaner as claimed in claim 8, wherein switch means are provided for switching on the light when the removable cover portion is opened to allow access to the airflow passage.

10. A vacuum cleaner as claimed in claim 9, wherein the switch means are connected in a manner to operate when the removable cover portion is opened.

11. A vacuum cleaner as claimed in claim 1, wherein cut-off means are provided for deactivating the brush bar when the removable cover portion is opened.

12. A vacuum cleaner as claimed in claim 11, wherein the cut-off means comprise a switch for cutting off a motor of the vacuum cleaner.

13. A vacuum cleaner as claimed in claim 11, wherein the cut-off means comprise a clutch for disengaging the drive of the brush bar.

14. A vacuum cleaner as claimed in claim 1, wherein the vacuum cleaner further comprises cyclonic separating apparatus.

15. A vacuum cleaner as claimed in claim 1, wherein the vacuum cleaner is an upright vacuum cleaner.

* * * * *